United States Patent [19]

Scott et al.

[11] Patent Number: 4,523,426

[45] Date of Patent: Jun. 18, 1985

[54] HIGH TEMPERATURE RESISTANT SEWING THREAD AND METHOD OF MAKING

[75] Inventors: Eddie W. Scott, Mebane; Errol N. Seltzer, Greensboro, both of N.C.

[73] Assignee: Collins & Aikman Corp., New York, N.Y.

[21] Appl. No.: 578,845

[22] Filed: Feb. 10, 1984

Related U.S. Application Data

[63] Continuation-in-part of Ser. No. 323,242, Nov. 20, 1981.

[51] Int. Cl.[3] ..... D01H 13/26; D01H 3/00

[52] U.S. Cl. ..... 57/247; 57/250; 57/295; 57/903; 57/908; 57/351

[58] Field of Search ..... 57/227, 237, 239, 241, 57/243, 245, 246, 248, 250, 258, 282, 286, 292, 295, 296, 297, 351, 903, 908; 28/1.4

[56] References Cited

U.S. PATENT DOCUMENTS

| | | | |
|---|---|---|---|
| Re. 29,572 | 3/1978 | Usdan | 57/247 |
| 3,041,816 | 7/1962 | Stuewer | 57/236 |
| 3,150,481 | 9/1964 | Bilsky et al. | 57/250 X |
| 3,879,928 | 4/1975 | Usdan | 57/250 X |
| 4,004,329 | 1/1977 | London et al. | 28/1.4 |
| 4,011,640 | 3/1977 | Keith | 28/1.4 |
| 4,016,715 | 4/1977 | London | 57/247 |
| 4,069,564 | 1/1978 | Trifunovic et al. | 28/273 |

FOREIGN PATENT DOCUMENTS

| | | | |
|---|---|---|---|
| 2025142 | 2/1977 | Japan | 57/250 |
| 4006939 | 1/1979 | Japan | 57/250 |

*Primary Examiner*—Donald Watkins

*Attorney, Agent, or Firm*—Bell, Seltzer, Park & Gibson

[57] ABSTRACT

In accordance with the invention there is provided a synthetic sewing thread of multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns. The thread is of substantially uniform cross section throughout, devoid of alternating thick and thin areas to provide a smooth more uniform sewing thread. The thread comprises a plurality of texturized continuous synthetic filaments, the filaments having a nonlinear crimped configuration providing bulk to the thread and being entangled with one another along the length of the thread by being directed through a fluid jet under a relatively high pressure of at least 80 p.s.i. and being further bound together by twist. The thread has a heat protective lubricant coating applied thereto and penetrating the filament bundle.

15 Claims, No Drawings

HIGH TEMPERATURE RESISTANT SEWING THREAD AND METHOD OF MAKING

FIELD AND BACKGROUND OF THE INVENTION

This application is a continuation-in-part of application Ser. No. 323,242, filed Nov. 20, 1981 and entitled High Temperature Resistant Sewing Thread.

This invention which is an improvement over our earlier copending application pertains to sewing thread, and more particularly to an improved continuous multifilament synthetic sewing thread which has the ability to withstand the relatively high temperatures generated by high speed industrial sewing machines and is characterized by being of substantially uniform cross section through the thread devoid of alternating thick and thin areas to provide a smoother more uniform sewing thread.

As pointed out in our earlier application, sewing threads formed of continuous multifilament synthetic yarns are known and have been used heretofore in certain sewing applications. This type of thread construction is generally less expensive to produce than sewing threads of conventional spun or corespun construction. However, the continuous multifilament sewing threads heretofore available have had certain inherent limitations which have limited their usefulness to a limited range of specific, relatively non-demanding application. For example, when such threads are sewn into a seam, they generally present a relatively shiny appearance quite different from that presented by sewing threads of a spun yarn or corespun construction. Such an appearance is unacceptable in many types of garments where the appearance of the stitch is highly important. Additionally, in seams formed with continuous multifilament sewing threads, individual filaments sometimes tend to separate from the remainder of the filament bundle, presenting an unacceptable fuzzy appearance. Another very significant limitation of the continuous multifilament sewing threads heretofore available has been that such threads have been incapable of withstanding any significant level of heat generated during the sewing operation. Consequently, such threads have been used primarily on lightweight fabrics and in applications where little heat is generated.

As further pointed out in our earlier application, perhaps one of the most demanding applications for a sewing thread is in the sewing of relatively heavy weight fabrics, e.g. buttom weight fabrics such as denims or corduroys. In forming seams in garments of such fabrics, it may be necessary to sew through as many as four to six plies of fabric. At the high speeds used in industrial sewing operations, very high temperatures are produced at the sewing needle when sewing such fabrics. The needle temperature may rise for example to 500 to 600 degrees F. or higher, sufficient to melt a synthetic sewing thread. In attempting to deal with the problems presented by such high needle temperatures, various efforts have been undertaken, such as directing compressed air at the needle for cooling, as well as various special needle designs specifically intended for cooling. Because of the extreme heat at the needle, bottom weight fabrics are typically sewn with a sewing thread of cotton sheathed corespun construction on the needle. On the looper, where the temperature is not as severe, threads of conventional cotton spun yarn construction are typically used. Synthetic sewing threads of a continuous multifilament construction have heretofore been unsuitable for use in these applications because of the inability to withstand the needle heat which is generated.

SUMMARY OF THE INVENTION

With the foregoing in mind, it is an important object of the present invention to provide an improved continuous multifilament sewing thread which is capable of withstanding the relatively high temperatures encountered in high speed industrial sewing operations, particularly in the sewing of relatively heavy weight fabrics, industrial fabrics such as tents, shoes, and canvas, and decorative stitching such as commonly applied to blue jeans.

In accordance with the present invention a synthetic sewing thread of multifilament construction has been provided which has the ability over our earlier application to further lessen the buildup of heat at the needle of a high speed sewing machine during the operation thereof, even during the sewing of relatively heavy weight fabrics, and industrial fabrics, so as to allow the thread to be utilized as a substitute for the sewing threads heretofore required in high temperature sewing applications, such as cotton spun yarns or cotton sheathed core yarns. The sewing thread of this invention is characterized by being of substantially uniform cross section throughout the thread devoid of alternating thick and thin areas to provide a smoother more uniform sewing thread. The thread comprises a plurality of texturized continuous synthetic filaments, the filaments having a nonlinear crimped configuration providing bulk to the thread and being entangled with one another along the length of the thread and further bound together by twist, and the thread having a heat protective lubricant coating applied thereto and penetrating the filament bundle.

Sewing threads in accordance with the present invention typically cover a wider range than in our earlier application and range in size from 70 to about 2,000 denier and may be of a singles or plied construction. The lubricant coating as in our earlier aplication is preferably a non-volatile liquid at room temperature and having a viscosity of about 90 to 250 cps at 70 degrees F. The preferred lubricant formulation is applied as a neat liquid and comprises silicone, polyethylene and a lubricant oil.

A particularly preferred thread construction in accordance with the invention comprises a synthetic sewing thread of continuous multifilament construction of substantially uniform cross section through the thread and devoid of alternating thick and thin areas as in yarns formed in accordance with the process of our earlier copending application. Threads of this invention by being of substantially uniform cross section have the ability to further lessen the buildup of heat at the needle of a high speed sewing machine during the operation thereof. The thread of this invention, as in our copending application, comprises a plurality of crimp texturized continuous synthetic filaments, each filament having a random nonlinear crimped configuration providing bulk to the thread and being randomly entangled with one another along the length of the thread. Each thread has a twist of from about 1 to about 6 turns per inch serving to further bind together the filament bundle and having a coating of about 3 to about 11 percent by weight of a heat protective liquid lubricant coating comprising silicone, polyethylene a lubricant oil.

In producing the sewing threads of this invention, one or more continuous multifilament synthetic yarns are treated with a particular mechanical treatment and with a special protective lubricant coating which imparts to the yarn the properties needed to effectively serve as a sewing thread in demanding high temperature applications. More specifically, the thread is produced by texturizing at least one continuous synthetic multifilament yarn to impart a nonlinear crimped configuration to the individual filaments thereof by directing said at least one yarn through a high pressure fluid jet of at least 80 p.s.i. while at the same time effecting entangling of the individual filaments with one another along the length of the yarn by the high pressure jet, imparting twist to said at least one yarn to further bind together the individual filaments, and applying to the thus processed yarn a heat protective lubricant coating. Heat is desirably applied to the crimped and entangled yarn, prior to applying the lubricant coating, to effect shrinkage of the yarn and to impart low shrinkage characteristics to the yarn and to stabilize the crimped and entangled yarn.

DETAILED DESCRIPTION

Sewing threads in accordance with the present invention are produced from one or more continuous multifilament yarns, made for example from a synthetic thermoplastic material such as nylon or polyester. The texturizing of the yarn is carried out by the Taslan process which utilizes high pressure air jets for crimping the yarn and entangling the filaments thereof with each other. Those skilled in this art are capable of selecting the appropriate processing conditions and size of air jets for the particular size and composition of yarn being processed so as to obtain a crimped yarn of the type described herein wherein the individual filaments thereof possess nonlinear crimp.

As already noted, the Taslan air jet serves to crimp and entangle and interlock the individual filaments, thus forming a coherent bundle of crimped filaments which prevents individual filaments from being separated from the filament bundle to present a fuzzy appearance to the yarn. The entanglement and interlocking of the filaments also serves to maintain a diffused appearance to the yarn rather than the shiny appearance normally characteristic of continuous filaments, by preventing the filaments from being aligned parallel to one another. When a singles yarn is produced, the single end is directed through the high pressure Taslan type air jet. In producing a plied yarn, two or more ends are brought together and passed through the high pressure air jet together so that the filaments of each yarn are crimped and entangled with one another to form a unitary textured filament bundle. The air jet is operated with compressed air of at least 80 p.s.i.

The yarn is subsequently heated and twisted to stabilize and further bind together the individual filaments into a unitary bundle, with a twist within the range of about 1 to 6 turns per inch being imparted to the yarn.

The protective lubricant coating, as in our earlier application, is especially formulated to lower the frictional properties of the sewing thread and to lubricate and cool the needle, thus enabling the sewing thread to run at significantly lower temperatures than heretofore possible. The cooler running characteristic of the sewing thread of this invention enables it to perform exceptionally well even in the most severe applications, such as in the high speed industrial sewing of several plies of relatively heavy bottom weight fabric having a weight of 8 ounces per square yard or greater. The protective lubricant composition is characterized by having excellent thermal stability at temperatures of about 350 to 400 degrees F. By thermal stability, we mean that under conditions of heat, the composition does not oxidize, become sticky or otherwise change chemically. The composition is a non-volatile liquid at room temperature and remains liquid at temperatures up to about 300 degrees F. Under the extreme elevated temperature conditions at the sewing needle, it is believed that the lubricant composition volatilizes, at least in part, thus contributing to the cooling of the needle. The lubricant is further characterized by having a relatively high heat capacity which enables it to receive and retain a large amount of heat energy during the sewing operation so as to thereby protectively shield the synthetic filaments from heat degradation or melting.

Lubricants conventionally used on sewing threads are typically solid wax-based compositions and must be applied in a heated molten condition at relatively heavy application rates, e.g. about 15 percent by weight. This class of lubricant composition presents difficulty in obtaining uniform application and complete penetration since the lubricant composition tends to cool and harden on the surface of the yarn and often on only one side thereof. Unlike these conventional sewing thread lubricants, the lubricant coating of this invention is a liquid at normal room temperature and is applied to the yarn by conventional methods of application, such as a kiss roll applicator. The liquid composition completely penetrates and uniformly coats the filament bundle. Also unlike many of the sewing thread lubricant compositions used commercially, which have a critical narrow tolerance for the amount of lubricant coating on the yarn, the protective lubricant coating formulation of this invention has a relatively broad tolerance for the amount of the composition on the yarn. The coating composition is preferably applied at a level within the range of about 3 to about 15 percent by weight.

The viscosity of the coating formulation is sufficiently low to enable it to uniformly coat and penetrate the bundle of filaments, but is not so low that it would sling off the thread during winding operations. Preferably, the viscosity of the formulation is maintained within the range of about 90 to about 250 cps at 70 degrees F. The constituents of the lubricant coating are non-volatile at room temperature, and the coating is applied to the thread as a neat liquid, i.e. without the use of diluents.

The primary constituent of the lubricant formulation is a liquid lubricant oil which is non-volatile at room temperature. Suitable lubricant oils may be selected from petroleum lubricating oils, lubricating oils derived from coal, synthetic lubricating oils, and mixtures of the above. Examples of synthetic lubricating oils include alkylene polymers, alkylene oxide polymers, esters of alkylene oxide polymers, esters of dicarboxylic acids, polyethers prepared from alkylene glycols, and fatty acid esters. The particular grade, composition and viscosity characteristics of the oil can be varied as needed in order to provide the overall formulation with a viscosity within the range noted above, and to this end it may be desirable to blend two or more lubricant oils of different viscosity characteristics. There are a number of commercially available lubricant oils which have been developed and marketed for use as yarn lubricants. These are generally either pure refined mineral oils or mixtures thereof with various additives, such as synthetic esters. Examples of commercially available lubricant oils suitable for use as yarn lubricants include Stantex 5050 or Stantex 5252, both products of Standard Chemical Products, and Lurol 1074A, a product of George A. Goulston Co.

Especially good results are achieved by including in the lubricant oil blend a relatively high viscosity polyisobutylene additive. This product has extremely low frictional properties and is marketed mainly as a low friction additive to motor oils. One such additive is marketed by A-Line Products of Detroit, Mich. under the designation PIO. This is a clear non-combustible non-flammable hydrofined oil having a density of 6.94 lb/gal. at 60 degrees F., and a viscosity of 10,600 SSU at 210 degrees F. Desirably, this additive is blended with the other oil components at a ratio of about 1:3 to about 1:6.

The protective lubricant composition also includes a silicone lubricant. Silicones are generally known for their lubricating properties and heat resistance, and various silicones are available commercially for use as thread lubricants. Typically the silicone compounds which have been developed as yarn lubricants are polymers or copolymers of dimethylsiloxane, and are generally available as clear or hazy white non-volatile oily liquids having a high flash point (usually above 400 degrees F.). These liquids are available in a wide range of viscosity grades. The silicone liquids suitable for use in the present invention desirably have a nominal viscosity of about 10 to 300 centistokes. Examples of commercially available polydimethysiloxane silicone fluids which may be used in the protective lubricant formulation of this invention include General Electric Silicone Fluid SF 96 or SF 97 and Dow Corning 200 Silicone Fluids.

The protective lubricant composition also includes a polyolefin, preferably a polyethylene of the emulsifible type. This class of polyethylene homopolymers and copolymers have been developed primarily for use on fabrics as an additive to permanent press resins or other finishing agents, and are intended for application in a water emulsion with the other finishing agents or resins. Examples of suitable commercially available polyethylenes include Allied Chemical's A-C series of polyethylenes.

In the protective lubricant composition of the present invention, polyethylene is mixed with the silicone and lubricant oil and serves to hold these normally incompatible constituents together as a stable liquid suitable for direct application without solvent or other diluent by conventional means, such as a kiss roll. The polyethylene also provides lubricity as well as serving to cool the sewing needle.

In formulating the lubricant composition, all of the components with the exception of the polyethylene are poured together and heated to about 180 degrees F. with agitation, following which the polyethylene is slowly added under strong agitation with continuous heating until the polyethylene is dissolved completely. Once all of the constituents are dissolved, heating is discontinued and the solution is cooled to room temperature.

The preferred protective lubricant composition for use in the present invention is the same as in our earlier application and consists essentially of about 5 to 20 percent silicone, about 2 to 8 percent by weight polyethylene, and the balance lubricant oil.

The following examples are intended to illustrate to those skilled in the art how to practice the invention and the results obtained thereby. These examples are not intended to be understood as limiting the invention.

EXAMPLE I

Two ends of POY DuPont Dacron 255/150/34 were fed as a core with one end of DuPont 240/150/68 as an effect strand into a Barmag FK6T80 machine equipped with a DuPont Taslan XIV Jet. This Barmag machine is equipped with a hot pin with the temperature of the same being set at about 150 degrees C. The first step of the process was the drawing of the thus identified three ends of polyester strands past the hot pin for obtaining the desired denier such as by using a 1.88 draw ratio for the two ends of 255/150/34 and a draw ratio of 1.78 for the effect end of 240/150/68. The DuPont jet was equipped with a needle No. 28, a Venturi No. 70 with an air pressure of 130 psi. The three ends thus passing through this high pressure air jet had their filaments crimped and entangled with each other. Preferably the two ends of polyester run as the core were wet with a water bath to enhance crimping and entanglement whereas the effect end was run dry. The two core ends were overfed to the jet about 25 percent with the effect end being overfed to the jet at about 5 percent. The processing speed of the ends through the machine was at about 300 meters per minute.

Following the passage of the three ends through the high pressure air jet to effect the crimping and entangling of the filaments, the thus entangled and crimped ends were then passed through a heated stabilizing zone having a plate heater where the consolidated yarn was underfed about 3 percent. This stabilizing zone served to reduce loop sizes extending along the consolidated yarn and to smooth the entangled crimped yarn. The thus stabilized yarn was then taken up on a package with the take-up speed set at about a 4 percent underfeed. In a separate operation the thus treated and processed ends were ply twisted six turns per inch and then coated with a heat resistant finish of the type previously described in detail.

EXAMPLE II

Using the same type of equipment as in Example I, four ends of DuPont Dacron 255/150/34 were drawn past the hot pin at 140 degrees C. at a 1.74 draw ratio, and an overfeed of about 22 percent to the DuPont Taslan XIV Jet. In this case, while the jet had a Venturi No. 70 the needle was a No. 28 instead of a No. 33 as in Example I. The four ends of polyester were run parallel into a wet box at 250 meters per minute following leaving the air jet and being crimped and entangled together. For stabilizing the yarn the yarn was underfed 8.8 percent into the heater set at 240 degrees C. instead of 235 degrees C. as in the first example. The package take-up was set at 2 percent underfeed and the product ply twist was set at 4.5 turns per inch and as in the first example a heat resistant finish of the type earlier described was subsequently applied.

It was learned by many trials that if the air pressure in the Taslan jet was 60 psi or lower, only air entanglement of the strands would be effected and no crimp would be imparted to the filaments. It was further learned that pressures of at least 80 psi and up to 150 psi or higher were effective for imparting crimp to the filaments as well as air entanglement of the filaments and the strands with each other. 130 psi is preferred since the best results appear to be obtainable at this pressure. Higher pressures can be utilized but presently, the attendant added cost is not justified for the results obtained.

As is well known to those versed in this art the changes of nozzle size are dictated by the yarn sizes with the psi remaining substantially the same for any given change of nozzle size, the volume of air being varied.

While the foregoing examples set forth ply twist of 6 and 4.5 turns per inch respectively, the broad range of ply twist is 1 to 6 turns per inch. As indicated earlier this ply twisting has been determined to be of importance in this sewing thread construction in that the ply twist tends to lock in the air entanglements and smooth the yarn on the surface to facilitate the passage of the same through the eye of the needle of the sewing machine with a minimum of interference.

It has been determined that where the yarn is to be dyed the yarn does not necessarily have to pass through the heaters on the Barmag machine. Tests have indicated that the heat generated during the dyeing of the yarn effects such shrinking of the yarn as to serve to stabilize the same by reducing the size of the loops extending from the surface of the yarn and thus to reduce the pick resistance and enhance the appearance of the yarn.

As indicated earlier the yarns formed according to this invention result in yarns having substantially uniform cross section throughout their length. Comparing these yarns with yarns presently being commercialized by false twist crimping, as disclosed in our parent application, indicates that the false twist crimped yarns are of a thick and thin nature throughout their length, the thin portions being located where the air entanglement tacking of the false twisted filaments takes place.

In the drawings and specification, there has been set forth a preferred embodiment of the invention, and although specific terms are employed, they are used in a generic and descriptive sense only and not for purposes of limitation.

That which is claimed is:

1. A synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread being further characterized by a substantially uniform cross section throughout the thread devoid of alternating thick and thin areas to provide a smoother more uniform sewing thread, said thread comprising at least one yarn having a plurality of crimped texturized continuous synthetic filaments, said crimped texturized filaments having a nonlinear crimped configuration providing bulk to the thread and being entangled with one another along the length of the thread, and further bound together by twist so as to provide a thread of substantially uniform cross section throughout the thread, and said thread having a heat protective lubricant coating applied thereto and penetrating the filament bundle.

2. A synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread being further characterized by a substantially uniform cross section throughout the thread devoid of alternating thick and thin areas to provide a smoother more uniform sewing thread, said thread comprising a plurality of multifilament yarns, each of said yarns having a plurality of crimped texturized continuous synthetic filaments, said crimped texturized filaments of each yarn having a nonlinear crimped configuration providing bulk to the thread and being entangled with one another and with filaments of the other yarns along the length of the thread, and further bound together by twist so as to provide a thread of substantially uniform cross section throughout the thread, and said thread having a heat protective lubricant coating applied thereto and penetrating the filament bundle.

3. A sewing thread according to claim 1 or 2 wherein said thread is shrunk so as to have low shrinkage characteristics and to stabilize the thread.

4. A sewing thread as set forth in claim 1 or 2 wherein said heat protective lubricant coating is a liquid having a viscosity at 70° F. of about 90 to 250 cps.

5. A sewing thread as set forth in claim 1 or 2, wherein said heat protective lubricant coating is a neat liquid comprising silicone, polyethylene and a lubricant oil.

6. A sewing thread as set forth in claim 5 wherein said heat protective lubricant coating comprises about 5 to 20 percent of said silicone, about 2 to 8 percent of said polyethylene, and the balance being said lubricant oil.

7. A synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread being further characterized by a substantially uniform cross section throughout the thread devoid of alternating thick and thin areas to provide a smoother more uniform sewing thread, said thread comprising at least one yarn having a plurality of crimped texturized continuous synthetic filaments, said crimped texturized filaments having a nonlinear crimped configuration providing bulk to the thread and being entangled with one another along the length of the thread and also being shrunk, and further bound together by a twist of from about 1 to about 6 turns per inch so as to provide a thread of substantially uniform cross section throughout the thread, and said thread having a heat protective lubricant coating of about 3 to about 15 percent by weight applied thereto and penetrating the filament bundle, and wherein the coating comprises silicone, polyethylene and a lubricant oil.

8. A method for producing a synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said sewing thread being further characterized by a substantially uniform cross section throughout the thread devoid of alternating thick and thin areas to provide a smoother more uniform sewing thread, said method comprising crimp texturizing at least one continuous synthetic multifilament strand to impart a nonlinear crimped configuration to the individual filaments thereof while at the same time entangling the individual filaments with one another along the length of the strand by directing the strand through a fluid jet under a relatively high pressure of at least 80 p.s.i. to simultaneously effect the crimping and entangling of the strand as it passes through the fluid jet, imparting a low twist to the thus crimped and entangled strand to further bind together the individual filaments, and applying to the thus processed strand a heat protective lubricant coating.

9. A method according to claim 8 wherein the crimp texturizing of the multifilament strand and entangling of the individual filaments thereof takes place by directing the strand through a fluid jet under a relatively high pressure of about 130 p.s.i.

10. A method according to claim 8 or 9 including stabilizing and imparting low shrinkage characteristics to the crimped and entangled strand by applying heat to the strand to shrink the strand prior to applying the heat protective lubricant coating.

11. A method according to claim 10 wherein the applying of heat to the crimped and entangled strand to shrink and stabilize the strand precedes the step of imparting a low twist to the crimped and entangled strand.

12. A method according to claim 10 wherein the applying of heat to the crimped and entangled strand to shrink and stabilize the strand follows the step of imparting a low twist to the crimped and entangled strand and comprises applying heat to the strand by dyeing of the strand in a heated dye bath.

13. A method as set forth in claim 8 or 9 wherein said step of applying a heat protective lubricant coating comprises applying to the strand a neat liquid comprising silicone, polyethylene, and a lubricant oil.

14. A method for producing a synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said sewing thread being further characterized by a substantially uniform cross section throughout the thread devoid of alternating thick and thin areas to provide a smoother more uniform sewing thread, said method comprising crimp texturizing at least one continuous synthetic multifilament strand to impart a nonlinear crimped configuration to the individual filaments thereof while at the same time entangling the individual filaments with one another along the length of the strand by directing the strand through a fluid jet under a relatively high pressure of at least 80 p.s.i. to simultaneously effect the crimping and entangling of the strand as it passes through the fluid jet, applying heat to the thus crimped and entangled strand so as to effect shrinkage of the strand and to impart low shrinkage characteristics and stabilization to the strand, imparting a low twist to the thus crimped and entangled shrunken strand to further bind together the individual filaments, and applying to the thus processed strand a heat protective lubricant coating.

15. A method for producing a synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said sewing thread being further characterized by a substantially uniform cross section throughout the thread devoid of alternating thick and thin areas to provide a smoother more uniform sewing thread, said method comprising crimp texturizing at least one continuous synthetic multifilament strand to impart a nonlinear crimped configuration to the individual filaments thereof while at the same time entangling the individual filaments with one another along the length of the strand by directing the strand through a fluid jet under a relatively high pressure of about 130 p.s.i. to simultaneously effect the crimping and entangling of the strand as it passes through the fluid jet, applying heat to the thus crimped and entangled strand so as to effect shrinkage of the strand and to impart low shrinkage characteristics and stabilization to the strand, imparting a low twist of from about 1 to about 6 turns per inch to the thus crimped and entangled shrunken strand to further bind together the individual filaments, and applying to the thus processed strand about 3 to 15 percent by weight of a heat protective lubricant coating comprising silicone, polyethylene, and a lubricant oil.

* * * * *